US008807448B2

(12) United States Patent
Nelson

(10) Patent No.: US 8,807,448 B2
(45) Date of Patent: Aug. 19, 2014

(54) FOLDABLE OR DETACHABLE FEED RAIL FOR ROCK DRILL

(75) Inventor: Yves Nelson, Algoma Mills (CA)

(73) Assignee: 1311854 Ontario Limited, Ontario (CA)

( * ) Notice: Subject to any disclaimer, the term of this patent is extended or adjusted under 35 U.S.C. 154(b) by 548 days.

(21) Appl. No.: 12/757,913

(22) Filed: Apr. 9, 2010

(65) Prior Publication Data

US 2011/0248092 A1 Oct. 13, 2011

(51) Int. Cl.
*E01B 11/00* (2006.01)
*E21B 7/02* (2006.01)

(52) U.S. Cl.
CPC ..... *E21B 7/025* (2013.01)
USPC ..... 238/166

(58) Field of Classification Search
USPC ..... 238/122, 140–142, 151, 166, 195, 196; 299/10, 18, 31, 32, 34
See application file for complete search history.

(56) References Cited

U.S. PATENT DOCUMENTS 1,072,273 A * 9/1913 Thull ..... 238/166
1,267,279 A * 5/1918 Scalpelli ..... 238/166
3,830,544 A * 8/1974 Wilson et al. ..... 299/18
4,391,471 A * 7/1983 Hauschopp et al. ..... 299/43
5,029,754 A * 7/1991 Frankel ..... 238/166

OTHER PUBLICATIONS

Canadian Examination Report from the Canadian Intellectual Property Office for related application CA2,699,396 mailed on Dec. 13, 2011.

* cited by examiner

*Primary Examiner* — R. J. McCarry, Jr.
(74) *Attorney, Agent, or Firm* — Allen J. Moss; Squire Patton Boggs (US) LLP

(57) ABSTRACT

A foldable feed rail for a rock drill is composed of two segments, a first beam defining a first rail segment and a second beam defining a second rail segment. The second beam may be pivotally connected to the first beam with a hinge to enable the second beam to be folded relative to the first beam. Alternatively, the second beam can be detachably connected to the first beam so that the second beam can be removed altogether from the first beam. This invention enables the feed rail to be shortened, thereby making the feed rail much easier to maneuver in mines.

14 Claims, 4 Drawing Sheets

FOLDABLE OR DETACHABLE FEED RAIL FOR ROCK DRILL

CROSS-REFERENCE TO RELATED APPLICATIONS

This is the first application filed for the present invention.

TECHNICAL FIELD

The present invention relates generally to mining equipment and, in particular, to hydraulic feed systems for rock drills.

BACKGROUND

A hydraulic feed system is a hydraulically powered apparatus that is used to linearly displace a rock drill along a feed rail. The hydraulic feed system may be mounted on a wheeled frame or vehicle for transport.

A recurring problem in the mining industry is the manoeuvrability of machinery inside the narrow drifts (underground road ways) inside mines. Not only are the drifts in mines typically very narrow, but they frequently have sharp corners, making it very hard to manoeuvre large machines. This is a serious problem with so-called "jumbos", i.e. large wheeled hydraulic feed systems that have long feed rails. The feed rails must be long enough to accommodate a rock drill, drill string, hose drum and centralizers. A traditional jumbo feed composed of a single long rail is thus exceedingly difficult to manoeuvre inside the drifts. A need therefore exists for an effective solution to this technical problem.

SUMMARY

In broad terms, the present invention provides a novel foldable or detachable feed rail for a rock drill. The feed rail comprises a first beam defining a first rail segment and a second beam defining a second rail segment that can be folded relative to, or detached from, the first beam. This enables the feed rail to be shortened for easier storage and transport. This also affords greater manoeuvrability, which is particularly important when moving the feed rail around tight corners inside mine drifts. The ability to shorten the feed rail also enables the rock drill to be used in applications where a shorter feed rail is desirable or necessary.

Accordingly, one main aspect of the present invention is a foldable feed rail for a rock drill feed system. The feed rail includes a first beam forming a first channel that defines a first rail segment and a second beam forming a second channel that defines a second rail segment, the first and second channels having substantially identical shapes to enable a rock drill to be fed along the first and second rail segments when the first beam is aligned with the second beam. The second beam is movable between an operative position in which the second beam is aligned with the first beam and an inoperative position in which the second beam is not aligned with the first beam.

Another main aspect of the present invention is a method of operating a foldable hydraulic feed system for a rock drill. The method entails unfolding a feed rail having a first beam defining a first rail segment and a second beam defining a second rail segment by moving the second beam relative to the first beam, locking the second beam to the first beam to ensure alignment of the first and second rail segments, and operating the feed system to displace the rock drill along the first and second rail segments of the feed rail.

Yet a further main aspect of the present invention is a foldable hydraulic feed system for rock drilling, the system comprising a first beam defining a first rail segment. The system also has a second beam defining a second rail segment having a channel shape substantially identical to the first rail segment, wherein the second beam is movable between an operative position in which the second rail segment of the second beam is aligned with the first rail segment of the first beam and an inoperative position in which the second rail segment of the second beam is not aligned with the first rail segment of the first beam. The system further includes a rock drill and a hydraulic feed system connected for hydraulically feeding the rock drill along the first and second rail segments.

Still another main aspect of the present invention is a method of installing ground support. The method entails installing rock bolts, re-bar, split sets or equivalent for ground support using only a first rail segment of a feed rail of a hydraulic feed system. The method involves disconnecting (detaching or folding) a second rail segment from the first rail segment to shorten the feed rail. The shortened feed rail can then be used for installing ground support. When the ground support installation is complete, the second rail segment can be easily and quickly reattached to the first rail segment to lengthen the feed rail for drilling rock.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals. It should furthermore be noted that the drawings are not necessarily to scale.

DETAILED DESCRIPTION

In general, and by way of introduction, the present invention provides a foldable or detachable feed rail for a hydraulic feed system for a rock drill. The feed rail is composed of two segments. One segment may be folded relative to the other or, alternatively, disconnected from the other segment. This enables the feed rail to be shortened for greater manoeuvrability, storage or operations where a shorter feed rail would be desirable.

Figure 1:
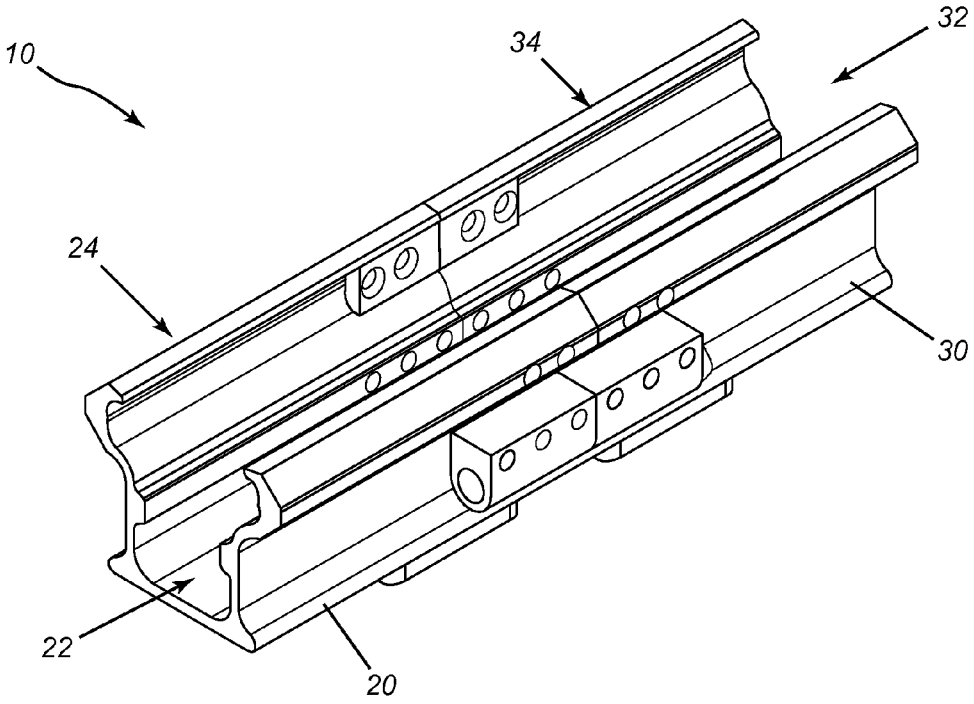
FIG. 1 is an isometric view of a novel feed rail in accordance with an embodiment of the present invention, the feed rail being shown in an aligned, locked and operative position.

FIG. 1 is an isometric view of a novel feed rail in accordance with an embodiment of the present invention. The novel feed rail, which is generally designated by reference numeral 10, is shown in this figure in an aligned, locked and operative position. The feed rail 10 comprises, in general, a first beam 20 forming a first channel 22 that defines a first rail segment 24 and a second beam 30 forming a second channel that defines a second rail segment 34. The first and second channels have substantially identical shapes to enable a rock drill (not shown) to be fed along the first and second rail segments 24, 34 when the first beam 20 is aligned with the second beam 30. The second beam 30 is movable between an operative position (shown in FIG. 1) in which the second beam is aligned with the first beam 20 and an inoperative position (shown for example in FIG. 5) in which the second beam 30 is not aligned with the first beam 20.

Figure 2:
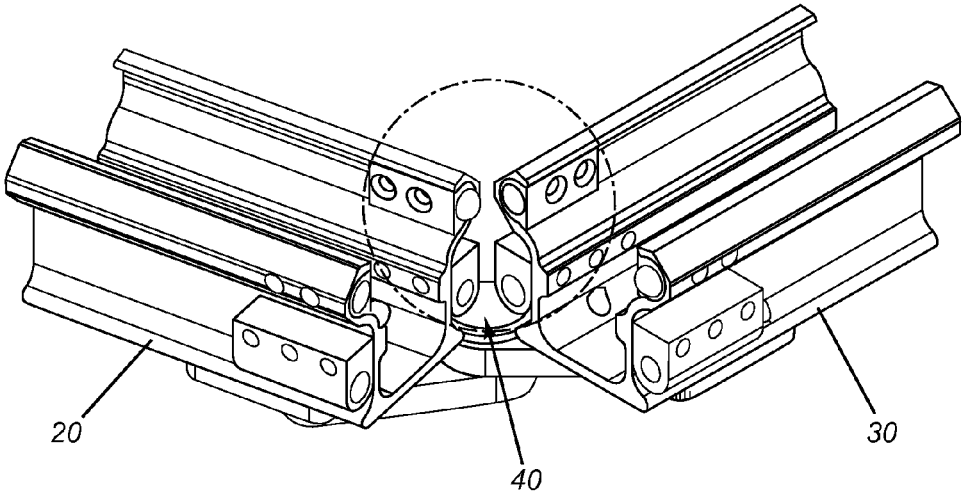
FIG. 2 is an isometric view of the feed rail of FIG. 1, the feed rail being shown in a partially folded position.

In one embodiment, the second beam 30 is pivotally connected to the first beam 20 by a hinge 40 as shown in FIG. 2. This hinge 40 enables the second beam 30 to be folded relative to the first beam 20. FIG. 2 shows the feed rail 10 in a partially folded position. In other words, FIG. 2 shows the second beam 30 pivoted relative to the first beam 20 about the hinge 40. Although a hinge is shown, other pivoting or rotational mechanisms may be employed to achieve a similar end result. Regardless of the mechanism, the ability to fold the feed rail facilitates transport, storage and enhances manoeuvrability.

Figure 5:
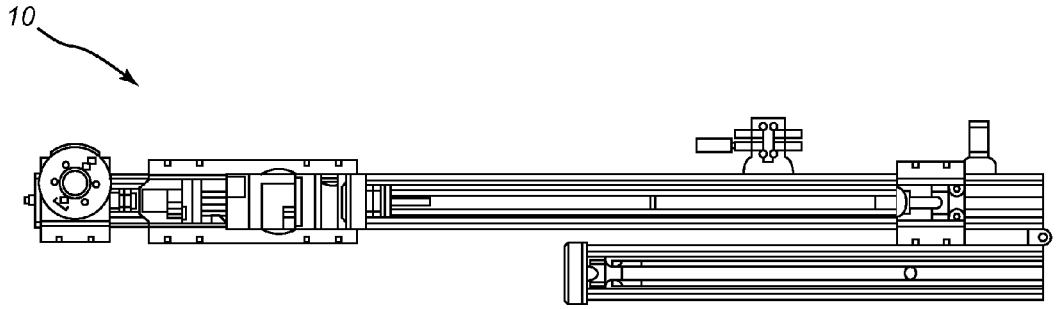
FIG. 5 is a top plan view of a fully folded hydraulic feed system for a rock drill.

In one embodiment, the second beam is hinged to the first beam to enable the second beam to be folded ninety degrees relative to the first beam such as shown by way of example in FIG. 5.

In the embodiment depicted in FIG. 2, the second beam 30 is shorter than the first beam 20, although this is not necessarily so.

In another embodiment, the second beam 30 is detachably connected to the first beam 20 such that the second beam 30 can be disconnected and removed from the first beam 20. The second beam can be detachably connected to the first beam using locking pins, bolts or other threaded fasteners, clamps, or any other suitable mechanism or attachment means.

Figure 3:
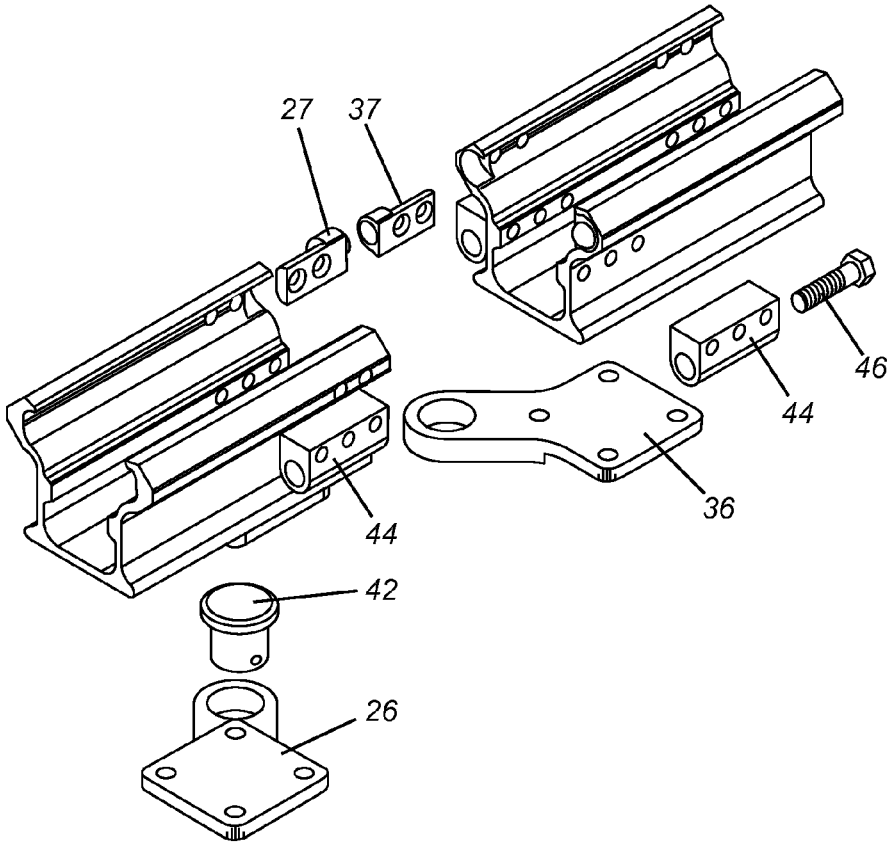
FIG. 3 is an exploded (assembly) view of the feed rail of FIG. 1.

FIG. 3 is an exploded (assembly) view of the feed rail of FIG. 1, showing the various components in the novel feed rail. FIG. 3 shows that the first and second beams 20, 30 are supported by respective support platforms 26, 36. As further depicted in FIG. 3, the first and second support platforms 26, 36 may be rotatably connected by a pin joint 42 to support the second beam 30 relative to the first beam 20 during rotation.

As further depicted in FIG. 3, the first and second beams 20, 30 may optionally comprise ball and socket alignment devices 27, 37 for aligning the second beam relative to the first beam. The ball and socket may be replaced with cones, pins, plates or similar line-up parts.

As further depicted in FIG. 3, the feed rail may optionally further comprise a locking mechanism having brackets 44 attached to both the first and second beams on sides opposite the hinge. The locking mechanism may have a threaded fastener 46 for locking the first and second beams together by connecting to the brackets 44. Other locking mechanisms could be substituted, e.g. clamps, hydraulic cylinders, etc.

Figure 4:
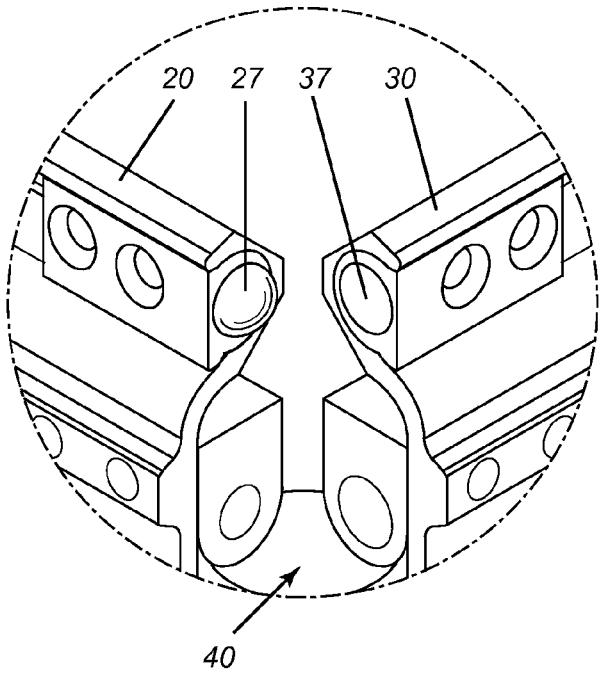
FIG. 4 is an enlarged isometric view of the hinge portion identified by the circle in FIG. 2.

FIG. 4 is an enlarged isometric view of the hinge portion identified by the circle in FIG. 2. This enlarged view shows the ball and socket alignment device in greater detail.

FIG. 5 is a top plan view of a fully folded hydraulic feed system for a rock drill. The foldable hydraulic feed system comprises the first beam defining the first rail segment, the second beam defining the second rail segment. The second beam is movable between the operative aligned position and the inoperative (disconnected or folded) position. In addition to the foldable/detachable feed rail, the system includes a rock drill and a hydraulic feed system connected to the rock drill for hydraulically feeding the rock drill along the first and second rail segments. The system may also include a drill string, hose drum and centralizers.

Figure 6:
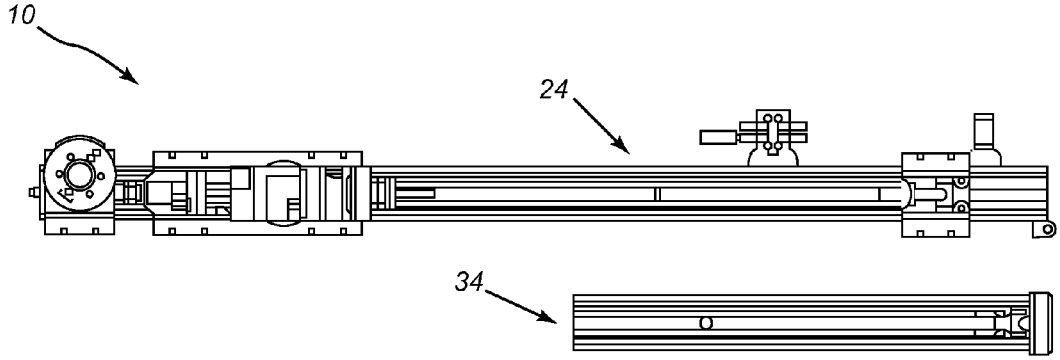
FIG. 6 is a top plan view of a feed system in which one segment has been detached from another segment in accordance with another embodiment of the present invention.
Figure 7:
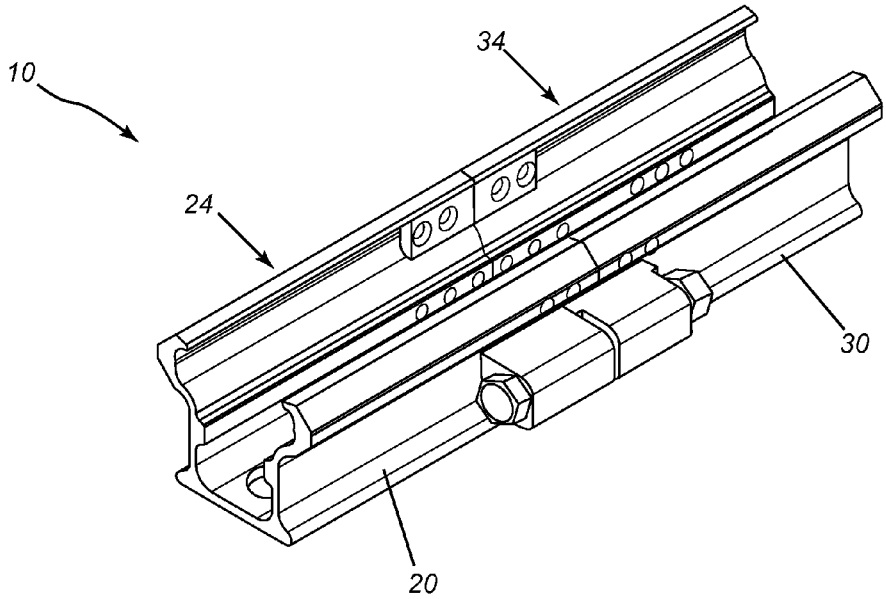
FIG. 7 is an isometric view of a first rail segment connected to a second (detachable) rail segment.
Figure 8:
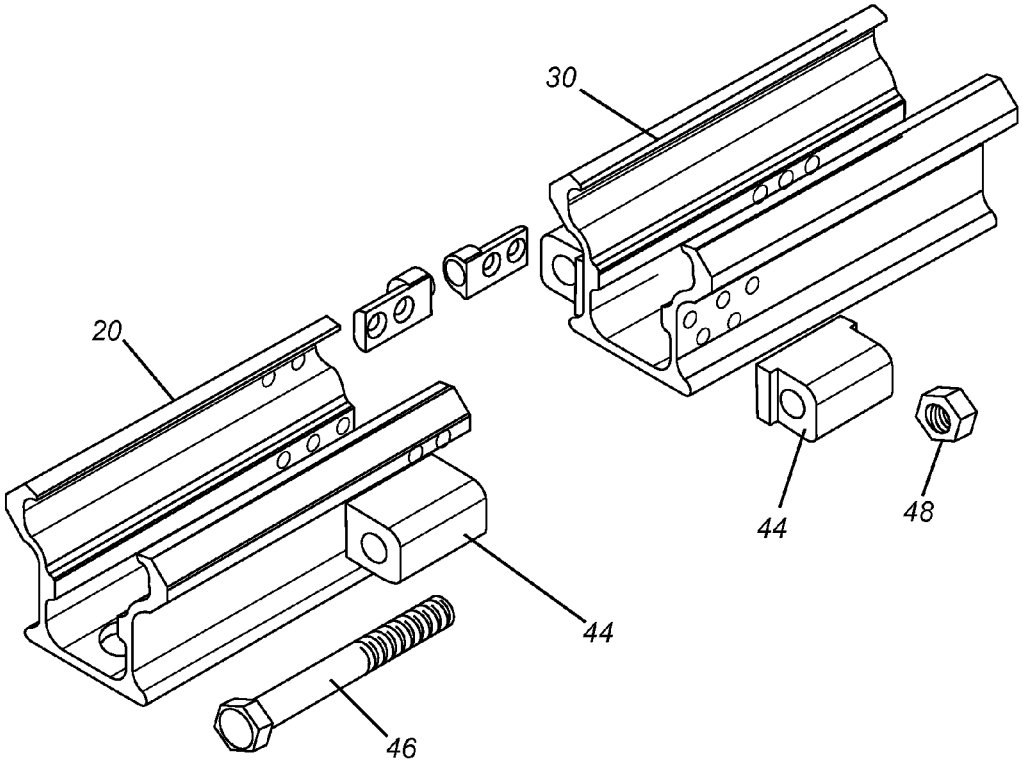
FIG. 8 is an exploded (assembly) view of the first and second rail segments of FIG. 7.

A further embodiment of this invention is depicted in FIG. 6 to FIG. 8. These figures show a detachable feed rail system 10 having a first rail segment 20 and a second rail segment 30 that is detachable from the first rail segment 10 as illustrated in FIG. 6. Removing or detaching the second rail segment 30 from the first rail segment 20 shortens the feed rail system 10. The first and second rail segments, when reattached, may appear as shown in FIG. 7. The first and second rail segments may be locked to one another by a locking pin, bolt or other fastener system, hydraulic cylinders, clamps, etc, or any combination thereof. By way of example only, FIG. 8 shows a bolt 46 that fits through the holes in brackets 44 and is affixed in place by nut 48.

The novel feed rail and system described above enable a novel method of operating a foldable hydraulic feed system for a rock drill. This novel method comprises unfolding (or reattaching) a feed rail having a first beam defining a first rail segment and a second beam defining a second rail segment by moving the second beam relative to the first beam. The second beam is locked to the first beam to ensure alignment of the first and second rail segments. Finally, the feed system is operated to displace the rock drill along the first and second rail segments of the feed rail.

When rock drilling is complete, the method may further involve unlocking the second beam from the first beam, and folding the second beam relative to the first beam (or detaching the second beam from the first beam), and then transporting the hydraulic feed system to a new location. In its shortened state, it is easy to manoeuvre, transport and store.

Alternatively, after the unlocking and folding (or detaching) steps, the hydraulic feed system may be used to feed the rock drill along only the first beam. With only the first beam defining the first rail segment installed, the shortened feed rail can be used for a variety of applications such as, for example, tramming or drilling the roof or walls for ground support. Specifically, one important application of this foldable/detachable feed rail technology is in the realm of rock bolting, i.e. installing rock bolts for ground support. To install rock bolts for ground support using this novel technology, the foldable/detachable feed rail is first folded or disconnected to shorten the feed rail to just a single rail segment. Rock bolts (or other such ground support devices) are then installed using the shortened feed rail. Optionally, a magazine storage device for the rock bolts could be mounted to the side of the feed to automate the process. Once the ground support has been completed, the extension beam (i.e. second rail segment) would be installed to lengthen the feed rail. This would enable a longer drill string to be used to drill the next round in the tunnel face for blasting. This detachable/foldable or detachable feed rail thus provides a substantial advantage over the two prior-art techniques that have traditionally been used. The first prior-art technique uses a bolter to install ground support. The bolter has a shorter feed to enable it to drill into the walls and the roof. Once the ground support is installed, the bolter is moved away and a new machine known as the drill jumbo is brought in to drill the tunnel face. This drill jumbo uses a longer feed because it is drilling in the same direction as the tunnel. The second prior-art technique is to use a drill jumbo fitted with a telescopic feed for collapsing the feed rail to install the rock support. The feed is then telescopically extended to drill the face. This telescopic drill jumbo does not function as well as the bolter and standard drill jumbo. Furthermore, the telescopic jumbo is bulky and has more moving parts to maintain. In contrast, the present invention provides a far superior rock bolting solution. The foldable or detachable feed rail provides the full-size of the jumbo in its lengthened configuration, but also the compactness and manoeuvrability of the bolter in its shortened configuration. This novel rock bolting apparatus is more compact than the telescopic feed and is more reliable and requires less maintenance as it has fewer moving parts. An optional bolt magazine can be added to the apparatus for easy storing and loading of rock bolts.

Another advantage of this invention is that the feed rail can be extended to allow for a longer drill string to be used. In other words, using modular components (i.e. modular rail segments or sections) enables the total length of the feed to be adjusted (shortened or lengthened). As long as the rail segments or rail sections share a common channel profile, they can be assembled and aligned along a common longitudinal axis to enable the rock drill and its carriage to slide along the rail. The rail segments (section) can be made in various lengths to provide any desirable incremental length. The user can then adjust the length of the feed for a given application and a given environment. This facilitates transport and storage, and improves manoeuvrability and versatility. Clearly, this represents a radical improvement over the fixed-length feeds known in the prior art which could be neither shortened nor lengthened.

Although the foregoing describes a feed rail composed of two components, i.e. a first beam and a second beam, it should be appreciated that the principles disclosed herein can be extrapolated to provide a feed rail having two or more components, i.e. two or more beams. For example, a feed rail may be composed of three beams, i.e. a first beam defining a first rail segment, a second beam defining a second rail segment and a third beam defining a third rail segment. Such an arrangement could includes a first hinge connecting the first and second beams and a second hinge connecting the second and third beams. As will be appreciated, this could also be extrapolated to a feed rail made of four, five or more components. Similarly, a detachable feed rail may be made with three, four, five or more beams that can be disconnected from one another. Although any number of articulations can in theory be utilized, the two-beam feed rail is believed to be the best mode of implementing the invention.

The feed rail, hinge mechanism, locking mechanism, and other components depicted in the figures may be made of steel, stainless steel, aluminum, or any suitable alloy. As will be appreciated by those skilled in the art of mechanical engineering, non-metallic materials, e.g. composite materials and polymers, may be used for some of the parts instead of metal. As will be further appreciated by those of ordinary skill in the art, various minor modifications to the construction and design of the feed rail and associated components may be made without departing from the inventive concept(s).

The present invention has been described in terms of specific embodiments, examples, implementations and configurations which are intended to be exemplary or illustrative only. Other variants, modifications, refinements and applications of this innovative technology will become readily apparent to those of ordinary skill in the art who have had the benefit of reading this disclosure. Such variants, modifications, refinements and applications fall within the ambit and scope of the present invention. Accordingly, the scope of the exclusive right sought by the Applicant for the present invention is intended to be limited solely by the appended claims and their legal equivalents.

The invention claimed is:

1. A foldable feed rail for a rock drill feed system, the feed rail comprising:

a first beam forming a first channel that defines a first rail segment configured to receive a rock drill; and a second beam forming a second channel that defines a second rail segment, the first and second channels having substantially identical shapes to enable the rock drill to be fed along the first and second rail segments when the first beam is aligned with the second beam, wherein the second beam is movable between an operative position in which the second beam is aligned with the first beam and an inoperative position in which the second beam is not aligned with the first beam, wherein the second beam is pivotally connected to the first beam by a hinge to pivot relative to the first beam about a pivot axis that is substantially orthogonal to a longitudinal axis of the first beam to enable the second beam to be folded relative to the first beam.

2. The feed rail as claimed in claim 1 wherein the second beam is shorter than the first beam.

3. The feed rail as claimed in claim 1 wherein the first and second beams comprise a ball and socket alignment device for aligning the second beam relative to the first beam, the first and second beams further comprising first and second support platforms rotatably connected by a pin joint to support the second beam relative to the first beam during rotation.

4. The feed rail as claimed in claim 1 further comprising a locking mechanism attached to both the first and second beams on sides opposite the hinge, the locking mechanism comprising a threaded fastener for locking the first and second beams together.

5. A method of operating a foldable hydraulic feed system for a rock drill, the method comprising:

unfolding a feed rail having a first beam defining a first rail segment and a second beam defining a second rail segment by pivoting the second beam relative to the first beam about a hinged connection defining a pivot axis that is substantially orthogonal to a longitudinal axis of the first beam;

locking the second beam to the first beam to ensure alignment of the first and second rail segments; and operating the feed system to displace the rock drill along the first and second rail segments of the feed rail.

6. The method as claimed in claim 5 further comprising, when rock drilling is complete:

unlocking the second beam from the first beam;

folding the second beam relative to the first beam; and transporting the hydraulic feed system to a new location.

7. The method as claimed in claim 5 further comprising:

unlocking the second beam from the first beam;

folding the second beam relative to the first beam; and using the hydraulic feed system to feed the rock drill along only the first beam.

8. A foldable hydraulic feed system for rock drilling, the system comprising:

a first beam defining a first rail segment;

a second beam pivotally connected by a hinge to the first beam about a pivot axis that is substantially orthogonal to a longitudinal axis of the first beam, the second beam defining a second rail segment having a channel shape substantially identical to the first rail segment, wherein the second beam is movable between an operative position in which the second rail segment of the second beam is aligned with the first rail segment of the first beam and an inoperative position in which the second rail segment of the second beam is not aligned with the first rail segment of the first beam;

a rock drill; and a hydraulic feed system connected to the rock drill for hydraulically feeding the rock drill along the first and second rail segments.

9. The system as claimed in claim 8 wherein the second beam is shorter than the first beam.

10. The system as claimed in claim 8 wherein the first and second beams comprise a ball and socket alignment device for aligning the second beam relative to the first beam.

11. The system as claimed in claim 8 wherein the first and second beams further comprise first and second support platforms rotatably connected by a pin joint to support the second beam relative to the first beam during rotation.

12. The system as claimed in claim 8 further comprising a locking mechanism attached to both the first and second beams on sides opposite the hinge, the locking mechanism comprising a threaded fastener for locking the first and second beams together.

13. A method of installing ground support, the method comprising:

providing a feed rail having a first rail segment pivotally connected to a second rail segment for feeding a rock drill for drilling rock, the second beam pivoting about a pivot axis that is substantially orthogonal to a longitudinal axis of the first beam;

folding the second rail segment relative to the first rail segment to shorten the feed rail; and installing rock bolts for ground support using only a first rail segment of the feed rail of a hydraulic feed system.

14. The method as claimed in claim 13 wherein installing rock bolts comprises loading rock bolts from a rock bolt magazine attached to the feed rail.

* * * * *